US011095966B2

(12) United States Patent
Wakeland et al.

(10) Patent No.: US 11,095,966 B2
(45) Date of Patent: Aug. 17, 2021

(54) ACOUSTIC DEVICE

(71) Applicant: Bose Corporation, Framingham, MA (US)

(72) Inventors: Ray Scott Wakeland, Marlborough, MA (US); Thomas A. Froeschle, Southborough, MA (US)

(73) Assignee: Bose Corporation, Framingham, MA (US)

( * ) Notice: Subject to any disclaimer, the term of this patent is extended or adjusted under 35 U.S.C. 154(b) by 12 days.

(21) Appl. No.: 16/737,733

(22) Filed: Jan. 8, 2020

(65) Prior Publication Data

US 2020/0145745 A1 May 7, 2020

Related U.S. Application Data

(63) Continuation of application No. 16/151,541, filed on Oct. 4, 2018, now Pat. No. 10,609,465.

(51) Int. Cl.
*H04R 7/10* (2006.01)
*H04R 1/10* (2006.01)
(Continued)

(52) U.S. Cl.
CPC ..... *H04R 1/1008* (2013.01); *H04R 1/1075* (2013.01); *H04R 1/1091* (2013.01);
(Continued)

(58) Field of Classification Search
CPC ..... H04R 1/10; H04R 1/1008; H04R 1/105; H04R 1/1066; H04R 1/1075; H04R 5/02;
(Continued)

(56) References Cited

U.S. PATENT DOCUMENTS 4,904,078 A * 2/1990 Gorike ..... G02C 11/06 351/158
6,758,303 B2 * 7/2004 Zurek ..... H04M 1/035 181/155

(Continued)

*Primary Examiner* — Huyen D Le
(74) *Attorney, Agent, or Firm* — Brian M. Dingman; Dingman IP Law, PC

(57) ABSTRACT

An acoustic device with an open audio device structure that is configured to be carried on the head or upper torso of a user, a housing carried by the open audio device structure, the housing having opposed first and second ends, a flat diaphragm in the housing and comprising a front face and a rear face, the diaphragm configured to radiate front acoustic radiation from its front face and rear acoustic radiation from its rear face, wherein the front and rear acoustic radiations are out of phase, structure that supports the diaphragm such that the diaphragm can move relative to the housing, a primary magnet adjacent to the rear face of the diaphragm, a magnetic circuit that defines a path for magnetic flux of the primary magnet, a voice coil that is exposed to the magnetic flux and is configured to move the diaphragm up and down along a radiation axis that is normal to the front face of the diaphragm, and first and second sound-emitting outlets in the housing, wherein the first sound-emitting outlet is in or proximate the first end of the housing and is acoustically coupled to the front face of the diaphragm so as to emit front acoustic radiation into an acoustic space, and wherein the second sound-emitting outlet is in or proximate the second end of the housing and is acoustically coupled to the rear face of the diaphragm so as to emit rear acoustic radiation into the same acoustic space.

17 Claims, 9 Drawing Sheets

(51) Int. Cl.

| | |
|---|---|
| ***H04R 1/28*** | (2006.01) |
| ***H04R 1/34*** | (2006.01) |
| ***H04R 1/38*** | (2006.01) |
| ***H04R 9/02*** | (2006.01) |
| ***H04R 9/06*** | (2006.01) |
| ***H04R 5/033*** | (2006.01) |

(52) U.S. Cl.
CPC ..... *H04R 1/2857* (2013.01); *H04R 1/2888* (2013.01); *H04R 1/347* (2013.01); *H04R 1/38* (2013.01); *H04R 5/033* (2013.01); *H04R 9/025* (2013.01); *H04R 9/06* (2013.01); *H04R 2201/105* (2013.01); *H04R 2499/11* (2013.01)

(58) Field of Classification Search
CPC ..... H04R 5/0335; H04R 2201/105; H04R 1/1091; H04R 1/2857; H04R 1/2888; H04R 1/347; H04R 5/033; H04R 9/025; H04R 9/06; H04R 2499/11
USPC ..... 381/327, 345, 349, 350, 351, 370, 381
See application file for complete search history.

(56) References Cited

U.S. PATENT DOCUMENTS

| | | | | |
|---|---|---|---|---|
| 2013/0051585 | A1* | 2/2013 | Karkkainen ..... | H04R 1/1075 381/151 |
| 2016/0255433 | A1* | 9/2016 | Grinker ..... | H04R 1/2873 381/380 |

* cited by examiner

ACOUSTIC DEVICE

CROSS-REFERENCE TO RELATED APPLICATION

This application is a continuation of and claims priority to application Ser. No. 16/151,541 filed on Oct. 4, 2018.

BACKGROUND

This disclosure relates to an electro-acoustic transducer that is adapted to be used in open audio devices.

Open audio devices allow the user to be more aware of the environment, and provide social cues that the wearer is available to interact with others. However, since the acoustic transducer(s) of open audio devices are spaced from the ear and do not confine the sound to the just the ear, open audio devices produce more sound spillage that can be heard by others as compared to on-ear headphones. Spillage can detract from the usefulness and desirability of open audio devices.

SUMMARY

All examples and features mentioned below can be combined in any technically possible way.

In one aspect, an acoustic device includes an open audio device structure that is configured to be carried on the head or upper torso of a user, and a housing carried by the open audio device structure, the housing having opposed front and rear faces and opposed first and second ends. There is a flat diaphragm in the housing that comprises a front face and a rear face, the diaphragm configured to radiate front acoustic radiation from its front face and into a front acoustic volume defined between the front face of the diaphragm and the front face of the housing and rear acoustic radiation from its rear face and into a rear acoustic volume defined between the rear face of the diaphragm and the rear face of the housing, wherein the front and rear acoustic radiations are out of phase. A flexible structure supports the diaphragm such that the diaphragm can move relative to the housing. There is a primary magnet proximate the rear face of the diaphragm, and a magnetic circuit that defines a path for magnetic flux of the primary magnet. There is a voice coil that is exposed to the magnetic flux and is configured to move the diaphragm up and down along a radiation axis that is normal to the front face of the diaphragm. There are first and second sound-emitting outlets in the housing, wherein the first sound-emitting outlet is in or proximate the first end of the housing, defines a center, and is acoustically coupled to the front acoustic volume so as to emit from the housing front acoustic radiation, and wherein the second sound-emitting outlet is in or proximate the second end of the housing, defines a center, and is acoustically coupled to the rear acoustic volume so as to emit rear acoustic radiation. A distance between the centers of the first and second sound-emitting outlets is greater than a distance along the radiation axis between the front and rear faces of the housing.

Embodiments may include one of the above and/or below features, or any combination thereof. The open audio device structure may be configured to be worn on the user's head such that the diaphragm radiation axis is transverse to a side of the head. The open audio device structure may comprise a temple piece of eyeglass headphones, and one of the first and second sound-emitting outlets may be configured to be close to the user's ear and the other of the first and second sound-emitting outlets may be configured to be farther from the ear.

Embodiments may include one of the above and/or below features, or any combination thereof. The diaphragm may be rectangular and may further comprise first and second parallel sides. The primary magnet may be rectangular and may comprise a front face, a rear face, and first and second parallel sides. The magnetic circuit may comprise a front pole piece between the front face of the primary magnet and the rear face of the diaphragm, a rear pole piece proximate the rear face of the primary magnet, and first and second side magnets, the first side magnet proximate to and spaced from the first side of the primary magnet and the second side magnet proximate to and spaced from the second side of the primary magnet, wherein the magnetic circuit defines a magnetic circuit gap between the primary magnet and the first and second side magnets. The voice coil may be located in the magnetic circuit gap. The housing may further comprise a frame that surrounds the magnetic circuit and the diaphragm and is configured to support the diaphragm. At least one of the first and second sound-emitting outlets may comprise an opening in the frame. The rear pole piece may define one of the first and second sound-emitting outlets.

Embodiments may include one of the above and/or below features, or any combination thereof. The acoustic device may further comprise a resistive port opening in the housing that receives the rear acoustic radiation and is spaced from the second sound-emitting outlet. The housing may comprise a rear pole piece of the magnetic circuit and the resistive port opening may comprise an opening in the rear pole piece. The second sound-emitting outlet may comprise an opening in the rear pole piece. The primary magnet may comprise two spaced primary magnet sections, and the second sound-emitting opening and the resistive port opening may be between the two spaced primary magnet sections.

Embodiments may include one of the above and/or below features, or any combination thereof. The acoustic device may further comprise a resistive port opening in the housing that receives the front acoustic radiation and is spaced from the first sound-emitting outlet. The primary magnet may further comprise two opposed ends, wherein the voice coil has a first depth in a magnetic circuit gap between the primary magnet and the first and second side magnets, and wherein the voice coil comprises an end section that is adjacent one of the opposed ends of the primary magnet and has a second depth that is less than the first depth. The primary magnet may comprise flat front and rear faces, wherein the magnetic circuit comprises a front pole piece that comprises a flat plate located on and coextensive with the front face of the primary magnet, and wherein the magnetic circuit further comprises a rear pole piece that comprises a flat plate located on and extending beyond a perimeter of the rear face of the primary magnet.

Embodiments may include one of the above and/or below features, or any combination thereof. The diaphragm may further comprise first and second sides and first and second ends, wherein the voice coil is adjacent to and spaced from both sides and both ends of the diaphragm, and wherein the voice coil is spaced farther from the first diaphragm end than it is from either of the sides of the diaphragm. The primary magnet may further comprise a first end proximate to the first diaphragm end, wherein the voice coil has a first depth in a magnetic circuit gap of the magnetic circuit, and wherein the voice coil comprises a first end section that is adjacent the first end of the primary magnet and has a second depth that is less than the first depth. The magnetic circuit may comprise a rear pole piece proximate a rear face of the primary magnet, and wherein the rear pole piece defines at least most of a rear wall of the housing.

In another aspect, an acoustic device includes a rectangular flat diaphragm comprising a front face and a rear face, first and second parallel sides, and first and second parallel ends that are each orthogonal to both of the diaphragm sides, the diaphragm configured to radiate front acoustic radiation from its front face and rear acoustic radiation from its rear face, a flexible structure that supports the diaphragm such that the diaphragm can move, a rectangular primary magnet proximate the rear face of the diaphragm and comprising a flat front face, a flat rear face, and first and second parallel sides, a magnetic circuit that defines a path for magnetic flux of the primary magnet, wherein the magnetic circuit comprises a front pole piece that comprises a flat plate located on and coextensive with the front face of the primary magnet, a rear pole piece that comprises a flat plate located on and extending beyond a perimeter of the rear face of the primary magnet, and first and second side magnets, the first side magnet proximate and spaced from the first side of the primary magnet and the second side magnet proximate and spaced from the second side of the primary magnet, wherein the magnetic circuit defines a magnetic circuit gap between the primary magnet and the first and second side magnets, a voice coil located in the magnetic circuit gap and configured to move the diaphragm, first and second sound-emitting outlets, wherein the first sound-emitting outlet is acoustically coupled to the front face of the diaphragm so as to emit front acoustic radiation, and wherein the second sound-emitting outlet is acoustically coupled to the rear face of the diaphragm so as to emit rear acoustic radiation, a housing that surrounds the magnetic circuit and the diaphragm, is configured to support the flexible structure, and is configured to direct at least one of the front acoustic radiation and rear acoustic radiation, wherein the housing has first and second opposed ends, and wherein the first sound-emitting outlet is in or proximate the first end of the housing and the second sound-emitting outlet is in or proximate the second end of the housing, wherein the housing defines the first sound-emitting outlet and the second sound-emitting outlet comprises an opening in the rear pole piece, and a resistive port opening that receives the rear acoustic radiation and is spaced from the second sound-emitting outlet, wherein the resistive port opening comprises an opening in the rear pole piece.

In another aspect an acoustic device includes a rectangular flat diaphragm comprising a front face and a rear face, first and second parallel sides, and first and second parallel ends that are each orthogonal to both of the diaphragm sides, the diaphragm configured to radiate front acoustic radiation from its front face and rear acoustic radiation from its rear face, a flexible structure that supports the diaphragm such that the diaphragm can move, a rectangular primary magnet proximate the rear face of the diaphragm and comprising a flat front face, a flat rear face, and first and second parallel sides, a magnetic circuit that defines a path for magnetic flux of the primary magnet, wherein the magnetic circuit comprises a front pole piece that comprises a flat plate located on and coextensive with the front face of the primary magnet, a rear pole piece that comprises a flat plate located on and extending beyond a perimeter of the rear face of the primary magnet, and first and second side magnets, the first side magnet proximate to and spaced from the first side of the primary magnet and the second side magnet proximate to and spaced from the second side of the primary magnet, wherein the magnetic circuit defines a magnetic circuit gap between the primary magnet and the first and second side magnets, a voice coil located in the magnetic circuit gap and configured to move the diaphragm, first and second sound-emitting outlets, wherein the first sound-emitting outlet is acoustically coupled to the front face of the diaphragm so as to emit front acoustic radiation, and wherein the second sound-emitting outlet is acoustically coupled to the rear face of the diaphragm so as to emit rear acoustic radiation, a housing that is configured to direct the front acoustic radiation, wherein the housing defines the first sound-emitting outlet, wherein the housing has first and second opposed ends and comprises a frame that surrounds the magnetic circuit and the diaphragm and is configured to support the flexible structure, wherein the second sound-emitting outlet comprises an opening in the frame, and wherein the first sound-emitting outlet is in the first end of the housing and the second sound-emitting outlet is in the second end of the housing, and a resistive port opening that receives the front acoustic radiation and is spaced from the first sound-emitting outlet, wherein the first sound-emitting outlet and the resistive port opening are both in the housing.

DETAILED DESCRIPTION

Figure 1:
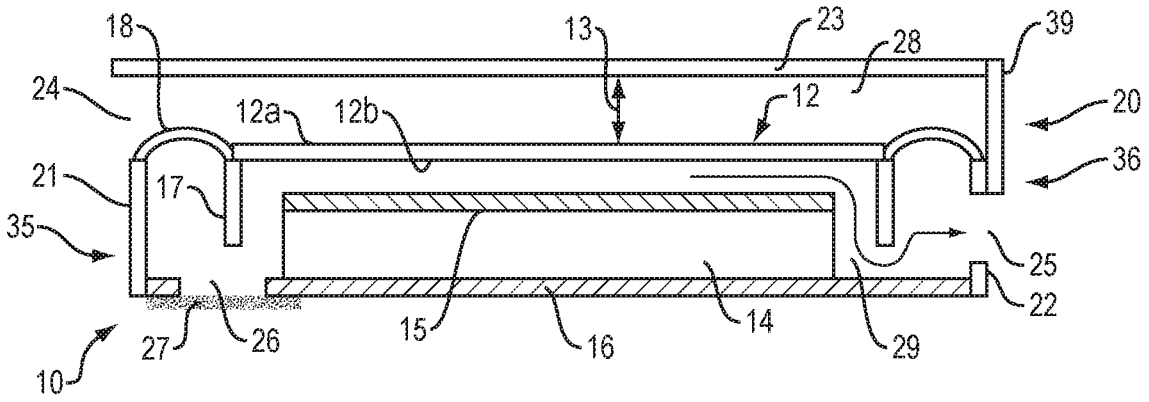
FIG. 1 is partial, schematic, cross-sectional view of an electro-acoustic transducer for an acoustic device.

The electro-acoustic transducer for the acoustic device of the present disclosure is very thin yet is able to exhibit dipole-like acoustic properties where sound in the far field is canceled. The transducer has two spaced sound-emitting openings. One opening receives sound from the front face of the transducer diaphragm. The other opening receives sound from the rear face of the diaphragm that is out of phase with the sound from the front face. The transducer is part of an acoustic device (e.g., an open audio device) that locates and orients the transducer such that one transducer opening is closer to the ear than is the other transducer opening. Sound from the opening that is closer to the ear is not completely canceled by sound from the other opening because the other opening is more distant. The transducer can thus be used in a low-spillage open audio device.

The transducer diaphragm is preferably but not necessarily flat or nearly flat. The voice coil can be but need not be located farther from one or both ends of the diaphragm than it is from the sides of the diaphragm. This creates a gap near an end of one face of the diaphragm; this face is typically but not necessarily the rear face. Acoustic radiation from this face can pass through this gap to one of the openings. This arrangement creates a transducer that emits sound from both faces of the diaphragm, where the sound is emitted out of separate openings. Because the sound is emitted from both faces of the diaphragm, the sound is inherently out of phase. The sound from the openings will thus tend to cancel in the far field, resulting in dipole-like behavior.

An electro-acoustic transducer includes an acoustic element (e.g., a diaphragm) that emits front-side acoustic radiation from its front side and emits rear-side acoustic radiation from its rear side. The diaphragm is preferably but not necessarily flat. This helps to keep the transducer thin. A housing or other structure directs the front-side acoustic radiation and the rear-side acoustic radiation. A plurality of sound-conducting vents in the structure allow sound to leave the structure. A distance between vents defines an effective length of an acoustic dipole of the transducer. The effective length may be considered to be the distance between the two vents that contribute most to the emitted radiation at any particular frequency. The structure and its vents can be constructed and arranged such that the effective dipole length is frequency dependent. The electro-acoustic transducer is able to achieve a greater ratio of sound pressure delivered to the ear to spilled sound, as compared to a traditional thin transducer with a flat diaphragm.

A headphone refers to a device that typically fits around, on, or in an ear and that radiates acoustic energy into the ear canal. This disclosure describes a type of open audio device with one or more electro-acoustic transducers that are located off of the ear. Headphones are sometimes referred to as earphones, earpieces, headsets, earbuds, or sport headphones, and can be wired or wireless. A headphone includes an electro-acoustic transducer driver to transduce audio signals to acoustic energy. The acoustic driver may be housed in an earcup. Some of the figures and descriptions following show a single open audio device. A headphone may be a single stand-alone unit or one of a pair of headphones (each including at least one acoustic driver), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality, such as a microphone.

In an around the ear or on the ear or off the ear headphone, the headphone may include a headband and at least one housing that is arranged to sit on or over or proximate an ear of the user. The headband can be collapsible or foldable, and can be made of multiple parts. Some headbands include a slider, which may be positioned internal to the headband, that provides for any desired translation of the housing. Some headphones include a yoke pivotally mounted to the headband, with the housing pivotally mounted to the yoke, to provide for any desired rotation of the housing.

An open audio device includes but is not limited to off-ear headphones (i.e., devices that have one or more electro-acoustic transducers that are coupled to the head but do not occlude the ear canal opening), and audio devices carried by the upper torso, e.g., the shoulder region. In the description that follows the open audio device is depicted as an off-ear headphone, but that is not a limitation of the disclosure as the electro-acoustic transducer can be used in any device that is configured to deliver sound to one or both ears of the wearer where there are no ear cups and no ear buds.

Exemplary electro-acoustic transducer 10 is depicted in FIG. 1, which is a schematic longitudinal cross-section. Electro-acoustic transducer 10 includes flat diaphragm 12 with front face 12*a* and opposed rear face 12*b*. Diaphragm 12 is located within housing 20. Housing 20 is mostly closed, except for a number of sound-emitting openings or vents. The housing and its vents are constructed and arranged to achieve a desired sound pressure level (SPL) delivery to a particular location, while minimizing sound that is spilled to the environment. These results make electro-acoustic transducer 10 an effective transducer for an open audio device such as an off-ear headphone. However, this disclosure is not limited to off-ear headphones, as the electro-acoustic transducer is also effective in other uses such as body-worn personal audio devices, for example.

Housing 20 in this instance comprises housing front wall 23, housing end wall 39, frame ends 21 and 22, and rear pole piece 16. Housing 20 defines an acoustic radiator front volume 28, and an acoustic radiator rear volume 29. Diaphragm 12 is configured to be moved up and down in the direction of arrow 13 (which may also be considered the diaphragm radiation axis) and thus radiates sound pressure into both volume 28 and volume 29, the sound pressure to the two different volumes being out of phase. Housing 20 thus directs both the front side acoustic radiation and the rear side acoustic radiation. Housing 20 comprises three (and in some cases two, or four or more) sound-emitting openings in this non-limiting example. Front opening 24, which could optionally be covered by a screen to prevent ingress of dust or foreign matter, is in or proximate first end 35 of housing 20 Rear opening 25 is in or proximate second end 36 of housing 20 and so is as far from front opening 24 as is possible given the size and shape of housing 20. Opening 25 could be covered by a screen to prevent ingress of dust or foreign matter. One of openings 24 and 25 should be close to the ear. Second rear opening 26 would typically be covered by a resistive screen 27, such as a 46 Rayl polymer screen made by Saati Americas Corp., with a location in Fountain Inn, S.C., USA; the acoustic impedance of the screen would be selected to achieve a desired resistance in light of the details of the rear port design, the area of opening 26, and the desired crossover frequency between the long and short dipole lengths. There can also optionally be a second front opening (not shown in FIG. 1) covered by a resistive screen to provide an optional passive element that can be included to damp standing waves, as is known in the art. When an opening is referred to as "resistive", it means that the resistive component is dominant.

A front opening and a rear opening radiate sound to the same acoustic space (e.g., see space 42, FIG. 2) outside of housing 20 in a manner that can be equated to an acoustic dipole. One dipole would be accomplished by opening 24 and opening 26. A second, longer, dipole would be accomplished by opening 24 and opening 25. An ideal acoustic dipole exhibits a polar response that consists of two lobes, with equal radiation forwards and backwards along a dipole radiation axis, and no radiation perpendicular to the axis.

Electro-acoustic transducer 10 as a whole exhibits acoustic characteristics of an approximate dipole (i.e., is dipole-like), where the effective dipole length or moment is not fixed, i.e., it is variable. The effective length of the dipole can be considered to be the distance between the two openings that contribute the most to acoustic radiation at any particular frequency. In the present example, the variability of the dipole length is frequency dependent. Thus, housing 20 and openings 24, 25, and 26 are constructed and arranged such that the effective dipole length of transducer 10 is frequency dependent. Frequency dependence of a variable-length dipole and its effects on the acoustic performance of a transducer are further described below. The variability of the dipole length has to do with which openings dominate at what frequencies. At low frequencies opening 25 dominates over opening 26, and so the dipole length is long. At high frequencies, opening 26 dominates (in volume velocity) over opening 25, and so the dipole spacing is short.

One or more openings on the front side of the transducer and one or more openings on the rear side of the transducer create dipole radiation from the transducer. When used in an open personal near-field audio system (such as with off-ear headphones, eyeglass headphones, or a torso-worn device), there are two main acoustic challenges that are addressed by the variable-length dipole transducer of the present disclosure. Headphones or other personal audio devices should deliver sufficient SPL to the ear, while at the same time minimizing spillage to the environment. The variable length dipoles of the present transducers allow the device to have a relatively large effective dipole length at low frequencies and a smaller effective dipole length at higher frequencies, with the effective length relatively smoothly transitioning between the two frequencies. For applications where the sound source is placed near but not covering an ear, what is desired is high SPL at the ear and low SPL spilled to bystanders (i.e., low SPL farther from the source). The SPL at the ear is a function of how close the front and back sides of the dipole are to the ear canal. Having one dipole source close to the ear and the other far away causes higher SPL at the ear for a given driver volume displacement. This allows a smaller driver to be used. However, spilled SPL is a function of dipole length, where larger length leads to more spilled sound. For a personal audio device, in which the driver needs to be relatively small, at low frequencies driver displacement is a limiting factor of SPL delivered to the ear. This leads to the conclusion that larger dipole lengths are better at lower frequencies, where spillage is less of a problem because humans are less sensitive to bass frequencies as compared to mid-range frequencies. At higher frequencies, the dipole length should be smaller.

As described above, one non-limiting manner of arranging the transducer such that one dipole source opening is located near the ear and another dipole source opening is located farther from the ear is to locate the openings in or very near the opposite ends of the housing. Another goal of the transducer is for it to be thin so that it can be carried near the ear but not be overly obtrusive. As depicted in FIG. 1, flat diaphragm 12 can be configured to move toward and away from the front and rear housing walls 23 and 16, respectively. Configuring housing 20 such that the distance between the centers of dipole source openings 24 and 25 is greater than the distance between front and rear housing walls 23 and 16 on a line normal to diaphragm front face 12*a* helps to accomplish a thin transducer with its dipole source openings spaced far enough apart to advantageously cancel sound in the far field.

Transducer 10 also includes flexible structure 18 (which may be but need not be a roll) that supports diaphragm 12 such that the diaphragm can move relative to housing 20. Primary magnet 14 is proximate to rear diaphragm face 12*b*. Magnet 14 may have but need not have flat top and bottom surfaces. A magnetic circuit defines a path for magnetic flux from magnet 14. The magnetic circuit comprises front pole piece 15 which may be a flat plate that sits on the top surface of magnet 14, as shown, and rear pole piece 16 which may be a flat plate that sits against the bottom face of magnet 14, as shown. Plate 16 may extend beyond the perimeter of magnet 14 so that plate 16 can form the rear wall of housing 20. Voice coil 17 is located in the magnetic circuit gap and is exposed to magnetic flux so that it moves the diaphragm up and down. Housing 20 also includes opposed frame wall ends 21 and 22. Walls 21 and 22 surround the magnetic circuit and the diaphragm. Housing end wall 39 is coupled to frame wall 22 and supports housing front wall 23 that overlies and is spaced from diaphragm 12 to define front volume 28 as well as front opening 24.

Figure 2:
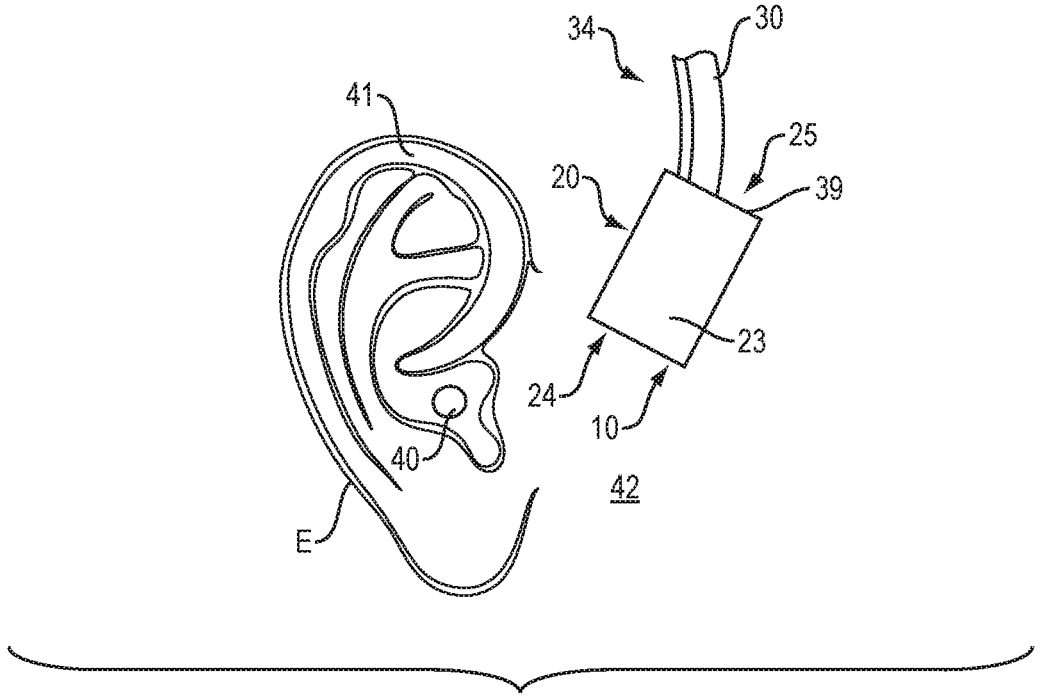
FIG. 2 is a side view of the electro-acoustic transducer of FIG. 1 in an acoustic device near an ear of a user.

In some non-limiting examples herein, the electro-acoustic transducer is used to deliver sound to an ear of a user, for example as part of a headphone or another type of open audio device. An exemplary headphone 34 is partially depicted in FIG. 2. Electro-acoustic transducer 10 is positioned to deliver sound to ear canal opening 40 of ear E with pinna 41. Housing 20 is carried by headband 30, such that the acoustic radiator is held near but not covering the ear. An alternative to headband 30 would be a structure that was mounted to the ear, or a structure carried by the head such as eyeglass open audio headphones. In order to keep the thickness of housing as small as possible, the direction of motion of the diaphragm (i.e., its radiation axis, as depicted by arrow 13, FIG. 1) is preferably transverse to (in one non-limiting example essentially perpendicular to) the side of the head. In FIG. 2, housing 20 is oriented such that its rear wall (e.g., rear pole piece 16) is against or very close to the cheek and front wall 23 faces out, away from the head. Housing 20 could be flipped around, with front wall 23 closest to the cheek. One of the two end sound emitting openings 24 and 25 is close to ear canal opening 40 and the other is spaced farther from the ear canal. Other details of headphone 34 that are not relevant to this disclosure are not included, for the sake of simplicity.

In the non-limiting example of FIG. 2, front opening 24 is closer to ear canal 40 than are back openings 25 and 26. All three openings radiate into acoustic space 42 that is around the ear and the side of the head. Opening 24 is preferably located anteriorly of pinna 41 and the tragus, and close to the ear canal. Sound escaping opening 24 is thus not blocked by or substantially impacted by the structure of the ear before the sound reaches the ear canal. Openings 25 and 26 are farther from the ear. The area of the openings 24, 25, and 26 should be large enough such that there is minimal flow noise due to turbulence induced by high flow velocity. Note that this arrangement of openings is illustrative of principles herein and is not limiting of the disclosure, as the location, size, shape, impedance, and quantity of openings can be varied to achieve particular sound-delivery objectives, as would be apparent to one skilled in the art.

One side of the acoustic radiator (the front side in the non-limiting example of FIGS. 1 and 2) radiates through an opening that is typically but not necessarily relatively close to the ear canal. The other side of the driver can force air through a screen, or through another opening (which may or may not be located at the end of a port). When the impedance of the port is high (at relatively high frequencies), acoustic pressure created at the back of the radiator escapes primarily through the screen. When the impedance of the port is low (at relatively low frequencies), the acoustic pressure escapes primarily through the end of the port. Thus, placing the screened vent closer than the port opening to the front vent accomplishes a longer effective dipole length at lower frequencies, and a smaller effective dipole length at higher frequencies. The housing and vents of the present loudspeaker are preferably constructed and arranged to achieve a longer effective dipole length at lower frequencies, and a smaller effective dipole length at higher frequencies. The variable-length dipole is thus frequency dependent.

Variable-length dipole electro-acoustic transducers are further disclosed in U.S. patent application Ser. No. 15/375,119, filed Dec. 11, 2016, the disclosure of which is incorporated herein by reference in its entirety for all purposes. Further, in some examples there may also be a second opening in the front cavity (not shown) that is opposite opening 18 and that helps to reduce intermodulation in the front acoustic cavity, as disclosed in U.S. patent application Ser. No. 15/647,749, filed Jul. 12, 2017, the disclosure of which is incorporated herein by reference in its entirety for all purposes.

Some of the electro-acoustic transducers shown in the figures are rectangular, and typically include two or four small magnets on the outside of the voice coil. In these transducers a central, positively polarized primary magnet is surround by two or four oppositely polarized secondary magnets that are part of the magnetic circuit of the transducer. There would typically but not necessarily be one secondary magnet spaced from and parallel to each of two long sides, or all four sides, of the primary magnet. The diaphragm is rectangular and flat. A problem with this arrangement for open audio devices (in which sound from both faces of the diaphragm is used) is that the flow of air in the rear acoustic space behind the diaphragm is highly restricted, and may not flow out the back or rear of the transducer with the appropriate phase to cancel far-field sound from the front of the diaphragm. All the air displaced at the rear of the diaphragm must flow through the small gaps around the voice coil. These gaps restrict the flow, often to an extent that the transducer does not act sufficiently like a dipole to be useful to cancel far-field sound.

In an open audio device it is desirable for the sound from one side of the diaphragm to exit from a "nozzle" close to the ear, and the sound from the other side of the diaphragm to exit much farther from the ear, at the other end of the transducer. This creates something like a dipole, with good far-field sound cancellation. Where air flow from the rear side of the diaphragm is restricted by the voice coil gap, the dipole behavior of the transducer is limited.

The dipole behavior of such transducers is improved in this disclosure by arranging the transducer such that sound from both sides of the diaphragm can exit the transducer such that, at least in approximation, the sound from the two sides of the transducer is out of phase and exits the transducer from openings that are far enough apart such that sound is not cancelled before it reaches the ear canal.

Another issue of concern with open audio devices that are worn on the head (such as eyeglass headphones) is that the transducer should be as thin as possible. Thin transducers can better fit into eyeglasses and other carriers that are worn on the head, and are less obtrusive and thus more desirable. Adding structure around the transducer to direct the front and/or back acoustic radiation can help achieve the goals of dipole behavior described above. However, this structure may add to the thickness of the transducer and so may not be desirable.

Several alternative transducer arrangements that can accomplish the desired behaviors are disclosed herein. In some arrangements the voice coil is moved farther from the primary magnet at one or both of the two opposed ends of the magnet. This can be accomplished by re-shaping the primary magnet such that its ends are pulled in, or by removing the secondary magnet at one or both ends of the primary magnet. These changes create a wider magnetic circuit gap at one or both ends of the primary magnet, and so allow the voice coil to be moved farther away from the primary magnet at the end(s). This creates a larger channel for airflow from the back of the transducer.

Figure 3A:
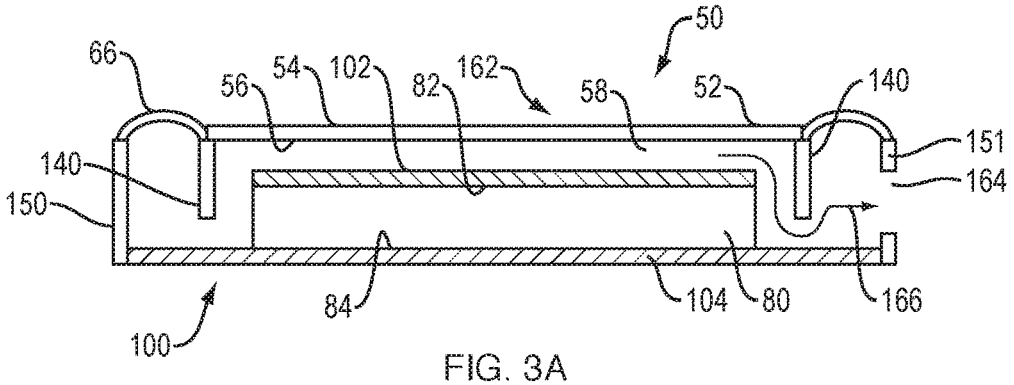
FIG. 3A is a schematic side view and FIG. 3B is a partial schematic top view of an electro-acoustic transducer for an acoustic device.
Figure 3B:
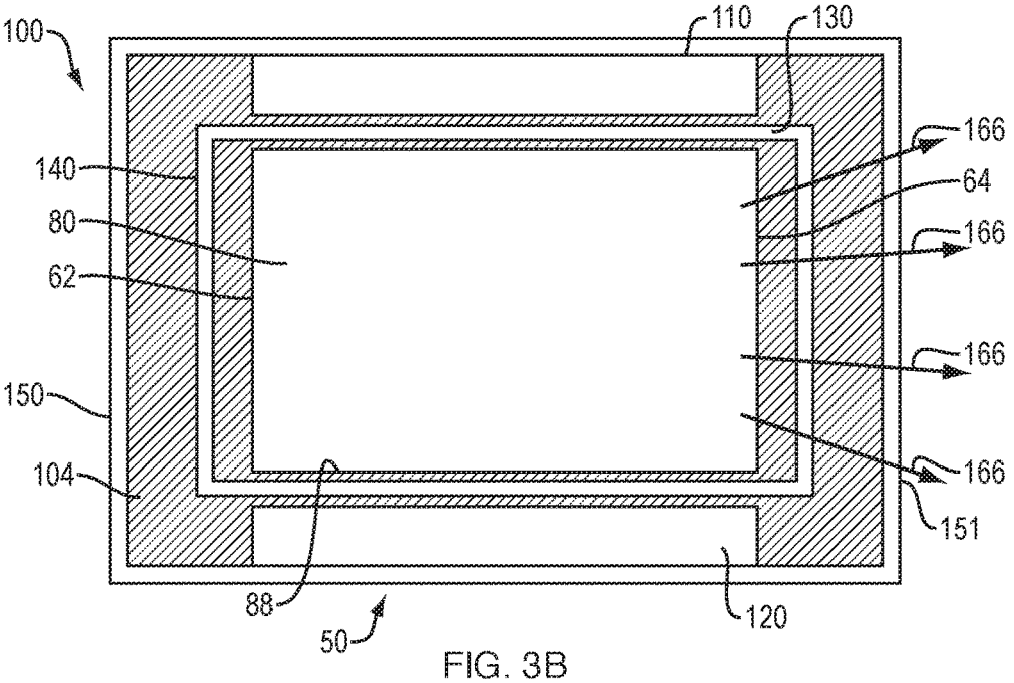

Electro-acoustic transducer 50, FIGS. 3A and 3B, accomplishes increased back-side airflow by removing the two end secondary magnets and moving the voice coil farther from the ends of the primary magnet, as described above. This provides a relatively open path to the end of the transducer from which the rear side radiation is emitted. Electro-acoustic transducer 50 comprises a rectangular flat diaphragm 52 comprising a front face 54 and a rear face 56. Diaphragm 52 has first and second longer parallel sides (not numbered in FIG. 3A). The diaphragm further comprises first and second parallel ends (not numbered in FIG. 3A) that are each orthogonal to both of the diaphragm sides The diaphragm is configured to be moved up and down via attached voice coil 140, in a manner known in the art. The diaphragm thus is configured to radiate front acoustic radiation from its front face and rear acoustic radiation from its rear face. Roll 66 supports the diaphragm such that the diaphragm can move up and down relative to frame 150 that supports the roll. Note that in most cases a housing front wall (not shown, but similar to wall 23, FIG. 1) would be included to direct front radiation to a front opening.

A rectangular primary magnet 80 is below and proximate to the rear face of the diaphragm. Magnet 80 comprises a front face 82, a rear face 84, and first 86 and second 88 parallel sides that are parallel to the parallel sides of the diaphragm. A magnetic circuit 100 defines a path for magnetic flux of the primary magnet. Magnetic circuit 100 comprises a front pole piece 102 between the front face of the primary magnet and the rear face of the diaphragm, a rear pole piece 104 adjacent the rear face of the primary magnet, and first 110 and second 120 side (secondary) magnets. The first side magnet is proximate to and spaced from the first side of the primary magnet and the second side magnet is proximate to and spaced from the second side of the primary magnet. These spaces are part of the magnetic circuit gap 130 between the primary magnet and the first and second side magnets. Voice coil 140 is located in this magnetic circuit gap, and is configured to move the diaphragm. The voice coil is proximate to and spaced from both sides and both ends of the diaphragm, and in this example (as shown in FIG. 3B) the voice coil is spaced farther from the first diaphragm end than it is from either of the longer sides of the diaphragm. Frame 150 surrounds the magnetic circuit and the diaphragm, and is configured to support the roll.

In transducer 50, the front and rear faces of the primary magnet are flat, and the front pole piece 102 comprises a flat plate located on and coextensive with the front face of the primary magnet. The rear pole piece 104 comprises a flat plate located on and extending beyond a perimeter of the rear face of the primary magnet. Frame 150 is coupled to and supported by the rear pole piece.

Transducer 50 has first 162 and second 164 sound-emitting outlets. The first sound-emitting outlet (which in this simplified example is the free air above the diaphragm) is acoustically coupled to the front face of the diaphragm so as to emit front acoustic radiation. The second sound-emitting outlet is acoustically coupled to the rear face of the diaphragm and rear acoustic cavity 58 so as to emit rear acoustic radiation. In this non-limiting example second outlet 164 comprises one or more openings in frame 150, the openings preferably being located in end 151 of the frame that is closest to end 64 of magnet 80 and the adjacent end of the diaphragm. The openings could be at the second end 62 of magnet 80. Arrows 166 generally indicate the flow of sound out of outlet 164.

Figure 3C:
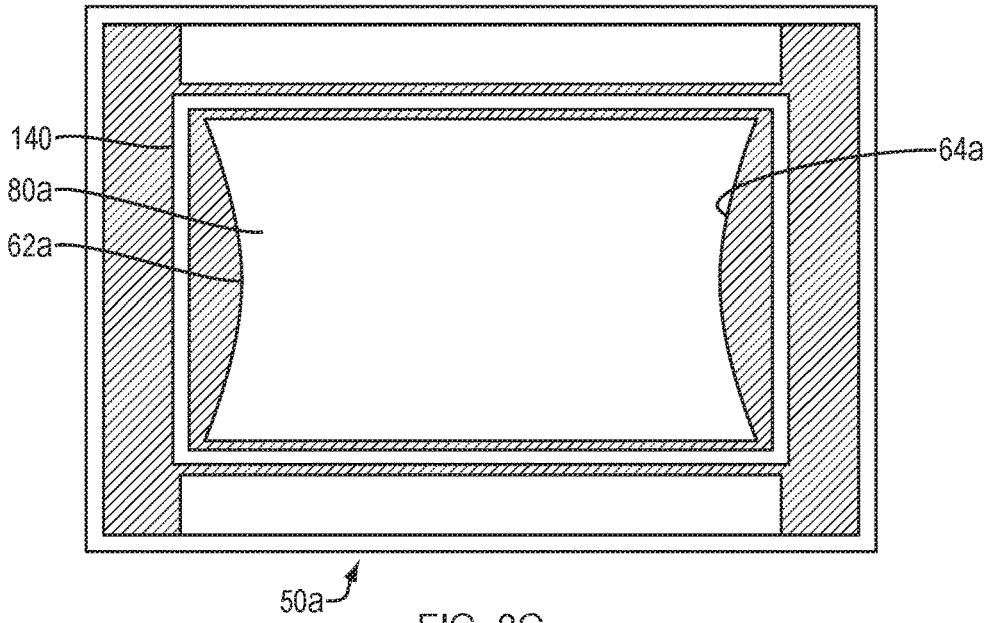
FIG. 3C is a partial schematic top view of an electro-acoustic transducer that is similar to that of FIG. 3A.

The two magnets that are sometimes found proximate the ends of the voice coil are not present. The voice coil is pushed out so as to increase the gap between the primary magnet and the voice coil, which provides a relatively open acoustic path from the back of the diaphragm to the end of the transducer. On the end opposite the nozzle, openings are provided in the plastic frame that surrounds the transducer and supports the outer surround landing. The two end magnets have both been removed on the assumption that the motor structure must remain symmetrical to avoid exciting excessive rocking. It might be possible to make better use of the voice coil with a primary magnet shaped as in transducer 50*a*, FIG. 3C, where narrow ends 62*a* and 64*a* of primary magnet 80*a* are moved back in order to create more space between these magnet ends and voice coil 140. Other magnet shapes are also contemplated herein, as the primary magnet does not need to be rectangular.

It should be understood that both FIGS. 3A and 3B are schematic. Also, to clarify aspects shown in FIG. 3B, FIG. 3B does not include diaphragm 52 or front pole piece 102. This allows the relationship of the four sides of the primary magnet to the coil to be visible in the figure.

It should also be understood that by "rectangular" we mean generally rectangular. When applied to the diaphragm and the primary magnet, by generally rectangular we mean they may include such features as radiused corners, or small indentations on the perimeter to assist in assembly or provide clearances to eliminate interference with other parts of the transducer during operation. It should also be understood that by "flat" we mean generally flat. When applied to the diaphragm, by generally flat we mean that a diaphragm might include ribs or variations in thickness in order to add stiffness or modify modal breakup behavior, but still be "flat" overall.

Figure 4A:
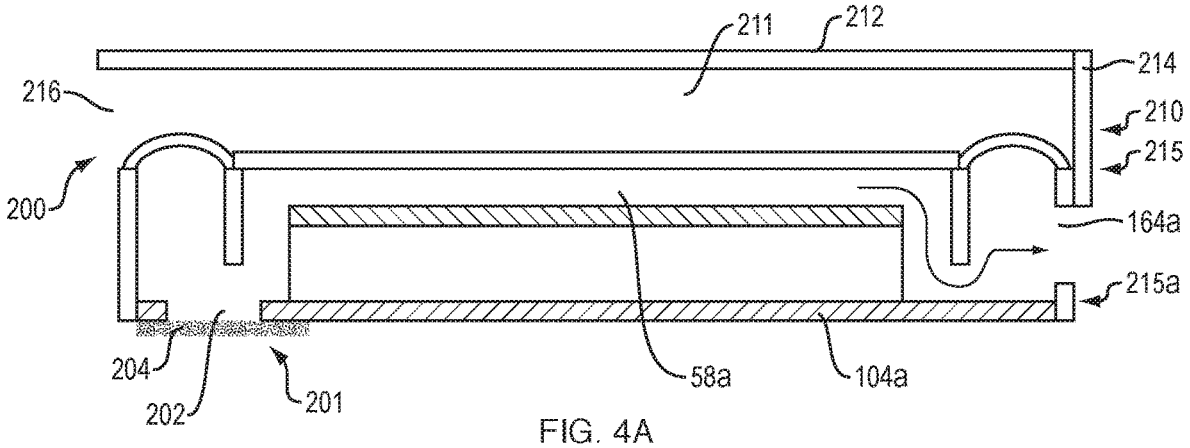
FIG. 4A is a schematic side view and FIG. 4B is a partial schematic top view of another electro-acoustic transducer for an acoustic device.
Figure 4B:
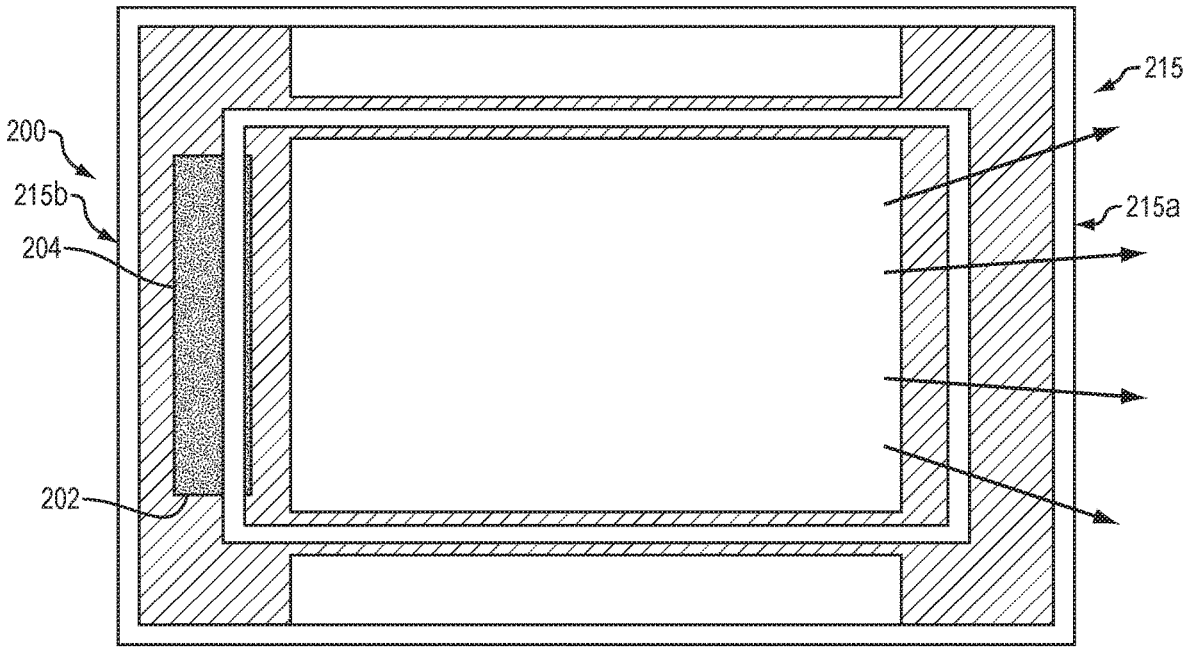

FIGS. 4A and 4B are similar to FIGS. 3A and 3B, but illustrate a transducer 200 that includes a housing 210 that is configured to direct at least one of the front acoustic radiation and rear acoustic radiation. Also, transducer 200 includes aspects of a variable length dipole as described above, where a portion of the rear pole piece on an end of the transducer that is close to the nozzle is opened up to create a resistive port opening that is covered by a resistive screen. Housing 210 may define one of the first and second sound-emitting outlets. The frame may define another of the first and second sound-emitting outlets. Alternatively, the rear pole piece may define another of the first and second sound-emitting outlets.

Housing 210 can be coupled to frame 150 (e.g., at housing end 214 as depicted) to create an assembly 215 that has first end 215*a* and second opposed end 215*b*. One sound-emitting outlet (e.g., rear side outlet 164*a*) acoustically communicates with rear acoustic cavity 58*a* and is in or proximate the first end of the assembly. Another sound-emitting outlet (e.g., front side outlet 216) is in or proximate the second end of the assembly. In the non-limiting example depicted in FIGS. 4A and 4B, the housing defines one of the sound-emitting outlets and the frame defines another of the sound-emitting outlets.

As described above, the transducer can also include a resistive port opening that can act as one opening of a dipole-like transducer. An example is port 201 comprising opening 202 that is exposed to rear radiation, where the opening is covered by resistive screen 204. In this example, port 201 is located in the rear pole piece and is configured to receive rear acoustic radiation.

Figure 10:
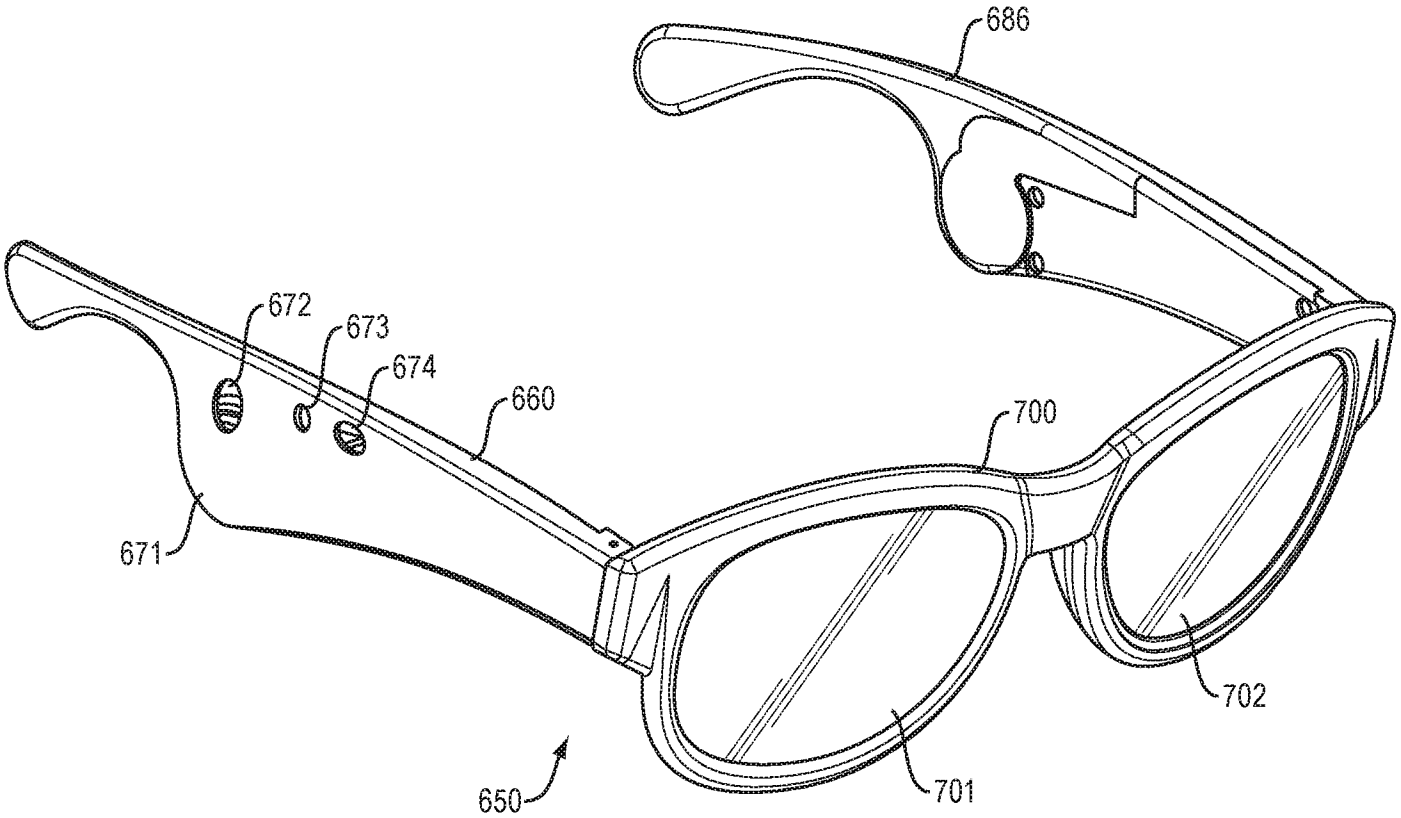
FIG. 10 is a front, perspective view of eyeglass headphones.
Figure 11:
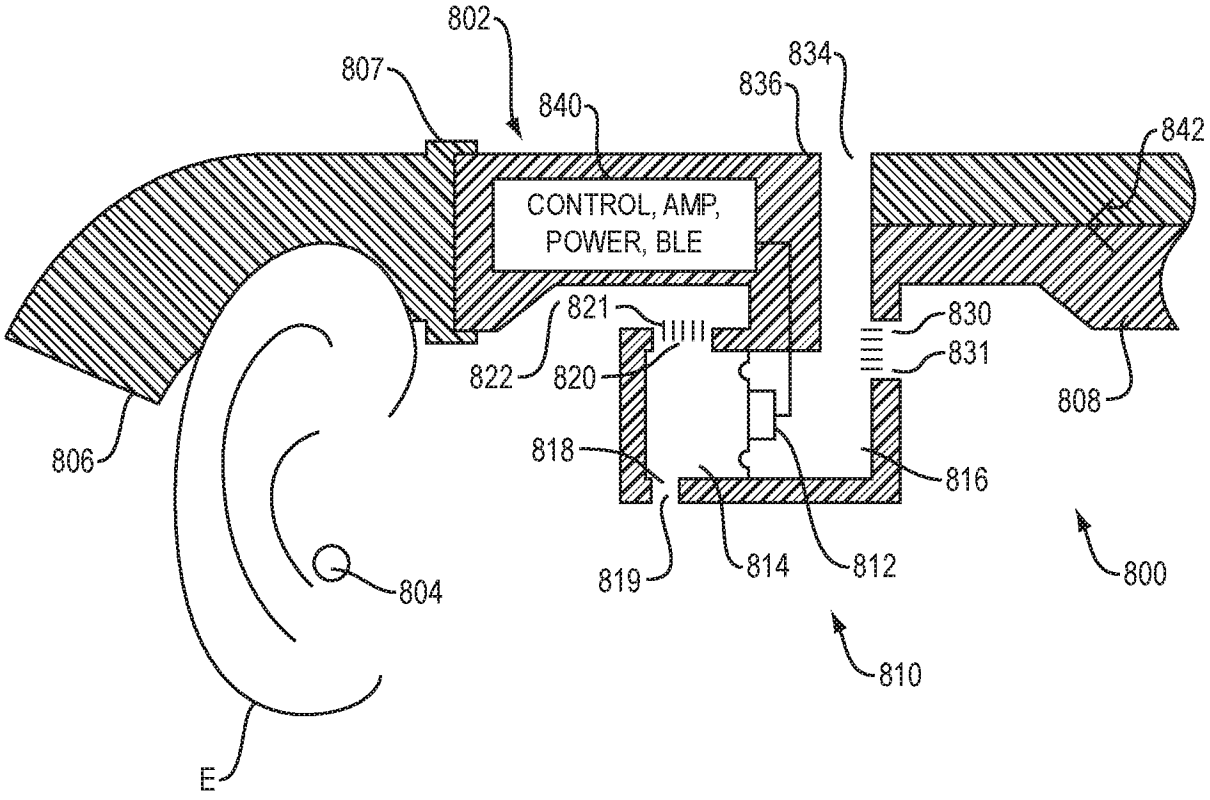
FIG. 11 is a schematic cross-sectional diagram of electronics, an antenna, and a dipole loudspeaker in one temple piece of eyeglass headphones.

If transducer 200 were used in an eyeglass headphone, such as the examples shown in FIGS. 10 and 11, the outer housing wall 212 that helps define front acoustic cavity 211 that leads to outlet or nozzle 216 could be on the inside of the temple piece, close to or against the cheek of the wearer. Back plate 104*a* of the transducer could be flush with the outer face of the glasses temple piece. If the transducer were long enough, it might be desirable to have the rear port also exit directly through the back plate of the transducer. The rear port would be covered with a water-resistant scrim. This could simplify manufacture, as all of the resistive materials could be added during the transducer manufacturing operation, rather than added post-manufacturing.

Figure 5:
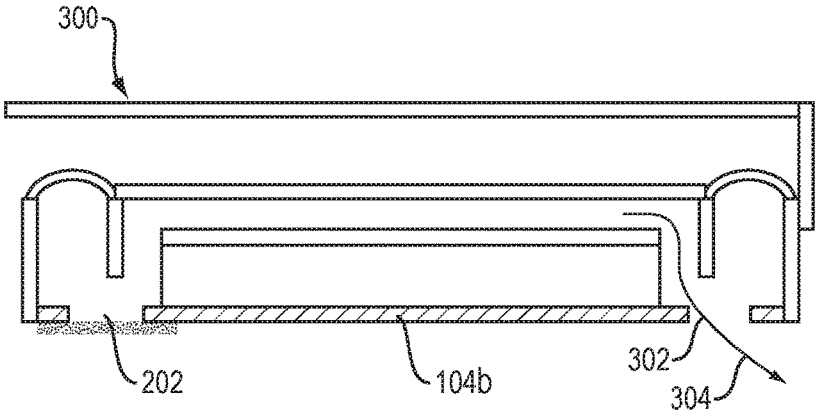
FIG. 5 is a schematic side view of another electro-acoustic transducer for an acoustic device.

Another alternative transducer arrangement is shown in FIG. 5, wherein transducer 300 comprises rear port 202. The major difference over transducer 200, FIGS. 4A and 4B, is that in transducer 300 the second sound-emitting outlet 302 is formed in rear pole piece 104*b*. Rear sound pressure flow is indicated by arrow 304.

Figure 6:
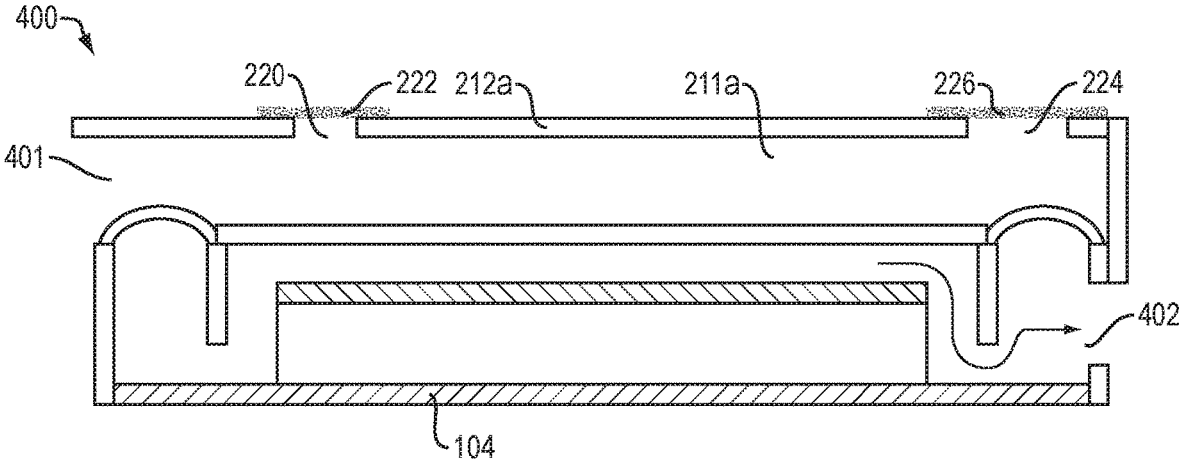
FIG. 6 is a schematic side view of another electro-acoustic transducer for an acoustic device.

Another alternative transducer arrangement is shown in FIG. 6, wherein transducer 400 has a resistive port opening 224 covered by resistive screen 226. Opening 224 receives the front acoustic radiation and is spaced from front sound-emitting outlet 401. Rear sound-emitting outlet 402 is also shown. In this non-limiting example the first sound-emitting outlet and the resistive port opening are both in the housing 212*a*, and the second sound-emitting opening 402 is in the frame. In this case, there may be more flexibility in locating the resistive port because the rear opening 402 can be used as the "nozzle" (i.e., the opening closest to the ear canal). This also allows the other resistive openings to be located on the outer face of the eyeglass temple piece, for example for damping undesirable modes in cavity 211*a* using opening 220 that may be covered by resistive screen 222.

Figure 7:
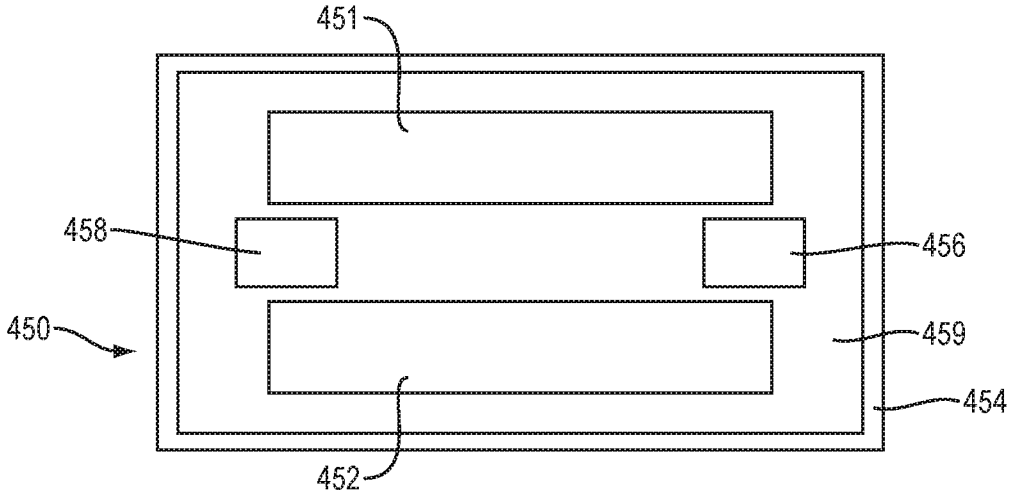
FIG. 7 is a partial schematic top view of another electro-acoustic transducer for an acoustic device.

Another alternative transducer arrangement is shown in a simplified schematic in FIG. 7, with only the relevant components shown. Transducer 450 has a primary magnet that comprises two spaced primary magnet sections numbered 451 and 452. Frame 454 is also shown. One of the sound-emitting openings and/or the resistive port opening are between the two spaced primary magnet sections. In the non-limiting example, openings 456 and 458 in rear pole piece 459 act as a sound-emitting opening and a resistive port. An advantage of putting openings in locations in the rear pole piece within the perimeter or extent of the voice coil is that the sound pressure does not need to move around the voice coil.

Figure 8A:
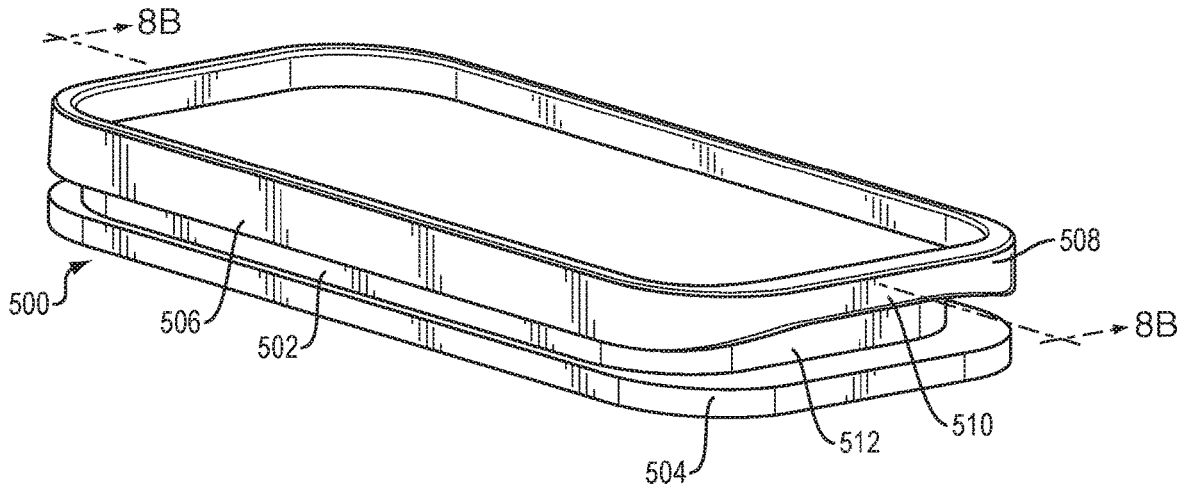
FIG. 8A is a schematic perspective view of a coil for an electro-acoustic transducer for an acoustic device.
Figure 8B:
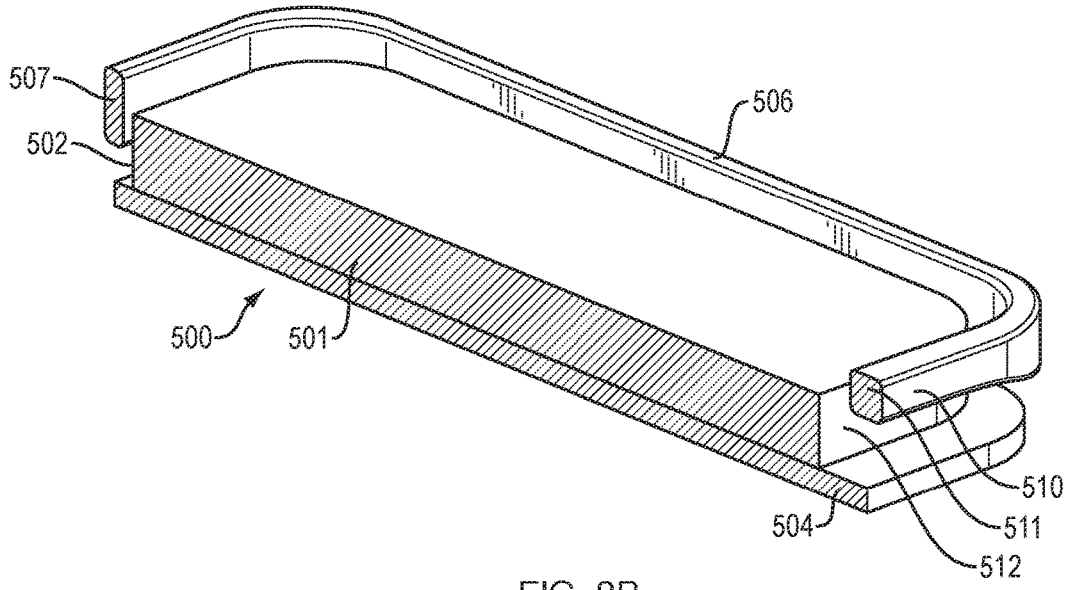
FIG. 8B is a cross-section taken along line 8B-8B of FIG. 8A.

FIGS. 8A and 8B illustrate an alternative transducer arrangement where a side of the voice coil where a sound-emitting outlet is located is reduced in height (i.e., shortened) as compared to other parts of the voice coil. This raises the bottom of the voice coil relative to the rear pole piece, and so creates a wider gap through which sound pressure can flow with less restriction. The voice coil can be pinched after it has been formed, so as to reduce its height. Since the portions of the voice coil near the ends of the magnet do not contribute much to voice coil motion, pinching the voice coil at an end may not have much effect on transducer operation. Assembly 500 illustrates only aspects of a transducer that help in understanding this voice coil arrangement. Primary magnet 501 sits on rear pole piece 504 and has opposed ends 502 and 512. Voice coil 506 has a first depth 507 in the magnetic circuit gap between the primary magnet and the first and second side magnets (not shown). The voice coil has an end section 508 that is adjacent to end 512 of the primary magnet. Part or all of end 512 is reshaped (e.g., shortened), as illustrated by portion 510. This can be done in a post coil forming operation, or during the winding of the coil. Portion 510 has a depth 511 that is less than depth 507.

Figure 9:
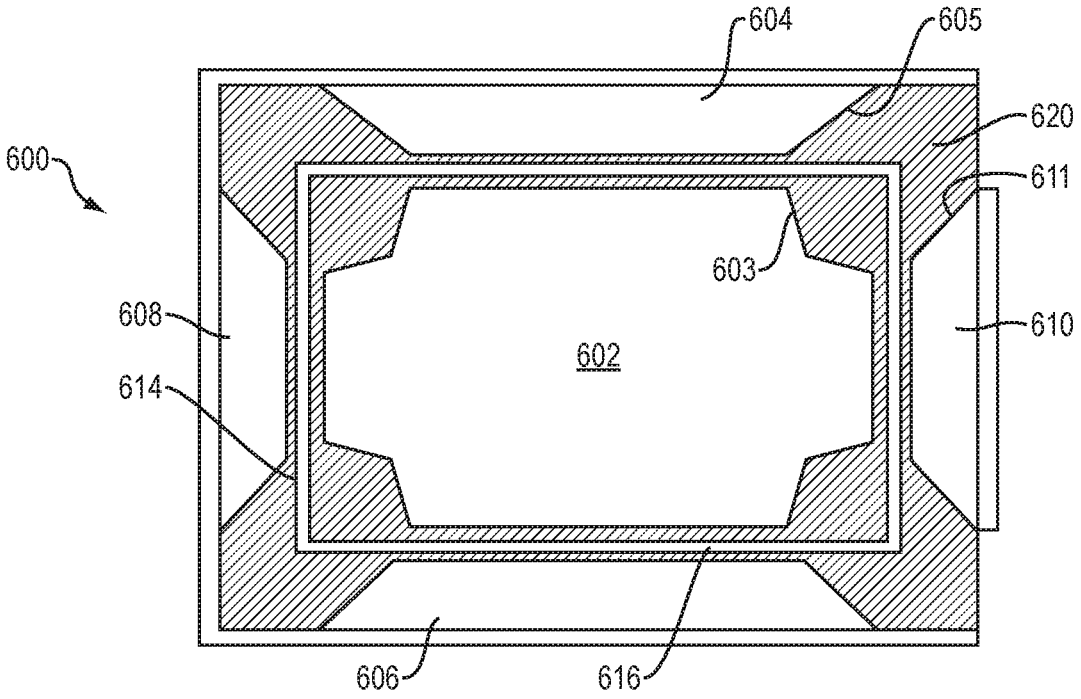
FIG. 9 is a partial schematic top view of another electro-acoustic transducer for an acoustic device.

FIG. 9 illustrates another exemplary transducer 600 with a rectangular primary magnet 602, voice coil 614 in voice coil gap 616, and four secondary side and end magnets 604, 606, 608, and 610. In this example, space between the voice coil and the magnets, added to increase sound pressure flow as described above, is created by modifying the shapes of one or more of the magnets, for example to remove the corners of any one of or all five magnets, as depicted for example by corner 603 of magnet 602, which has been pulled back so the corner is not squared off. Also, adjacent sides 605 and 611 of secondary magnets 604 and 610, respectively, can be pared back as shown. The same shapes are shown with the other side and end magnets. The reconfiguration of nominally rectangular magnets creates a wide space (e.g., space 620) through which sound pressure can move.

In another alternative arrangement, a resistive leak is created in the middle of the diaphragm, e.g., with an opening in the diaphragm covered by a resistive screen (not shown). This can reduce intermodulation distortion caused by a Helmholtz resonance that is modulated in frequency because of the changing volume under the diaphragm. The diaphragm might be completely flat. The diaphragm may be a thin composite laminate, which might be able to support a resistive screen. Alternately, a plurality of micro-perforations directly through the diaphragm material (not shown) may be used instead of a larger screened opening.

The subject transducer can potentially be assembled using the highly automated and precise mass-production construction methods used to make cellphone speaker transducers, but with modifications that make the result suitable for low-spillage open-audio applications where the air from the back of the diaphragm is used to cancel the far-field radiation from the front of the diaphragm. A benefit of this type of transducer is its thinness, which is highly desired in applications such as eyeglass headphones.

FIG. 10 is a front, perspective view of eyeglass headphones 650. Eyeglass headphones are further detailed in U.S. patent application Ser. No. 15/884,924, filed on Jan. 31, 2018, the entire disclosure of which is incorporated herein by reference for all purposes. In this non-limiting example there is an eyeglass bridge 700 that is constructed and arranged to sit on the nose, with lenses 701 and 702 in front of the eyes. Right temple piece 660 is coupled to bridge 700 and extends over the right ear. Left temple piece 680 is coupled to bridge 700 and extends over the left ear. Each temple piece comprises a dipole loudspeaker. The loudspeaker is typically located in enlarged temple portion 671 that is arranged to be located just in front of the ear. Visible in this view are rear high-frequency dipole opening 672 (which equates to opening 26, FIG. 1), rear low-frequency dipole opening 674 (which equates to opening 25, FIG. 1), and rear resonance damping opening 673. Any or all of these three openings can be covered by a screen, as described above. The screen covering opening 673 is preferably resistive, to accomplish waveguide resonance damping, as described above. Note that in this example the left temple piece 680 has a dipole transducer that is the same as that disclosed herein for the right temple piece.

FIG. 11 is a schematic cross-sectional diagram of system 800 comprising electronics, an antenna, and a dipole loudspeaker in one temple piece of eyeglass headphones. Note that FIG. 11 is schematic and is meant to represent certain features of eyeglass headphones, without limiting the disclosure in any manner. Temple piece 802 includes posterior end 806 that sits on ear "E" which has ear canal opening 804. Anterior temple end 808 is coupled to an eyeglass bridge (not shown). Dipole loudspeaker 810 is built into temple piece 802 in a manner such that nozzle 818 is close to ear canal opening 804. Note that in some but not all cases there would be a system 800 in each of the two temple pieces of the eyeglasses, so that sound is delivered very close to both ears.

Loudspeaker 810 includes driver 812 that radiates into front volume 814 and back volume 816. Front volume 814 includes nozzle vent 818 that is aligned with opening 819 in temple piece 802, so that sound can escape via nozzle 818. Having the nozzle built into an eyeglass temple allows the nozzle to be located close to and in front of the ear, which allows sound to be best delivered to ear canal opening 804. Temple piece 802 can be (but need not be) made adjustable in length so that the user can place nozzle 818 in desired proximity to ear canal opening 804. This adjustable length feature is schematically depicted by joint 807 that allows ends 806 and 808 to move relative to one another, closer together or farther away. Front volume 814 also can include opposed resistive vent 820 that is aligned with opening 821 in temple piece 802, so that sound can escape via vent 820. Cavity 822 in temple piece 802 is acoustically coupled to opening 821. Cavity 822 should have enough volume to allow flow through opening 820, to damp the resonance in front volume 814. Back volume 816 includes resistive opening 830 that is aligned with opening 831 in temple piece 802, so that sound can escape via opening 830. Back volume 816 also includes mass port opening 834 at the end of elongated transmission line cavity or port 836 in temple piece 802.

Control, amplification, power, and wireless communications (e.g., Bluetooth low energy or BLE), and other necessary or desirable functions, are provided by electronics 840, which is built into or otherwise carried by temple piece 802. Electronics 840 supply audio signals to driver 812, and supply communication signals to optional built-in antenna 842. Antenna 842 can be located in the anterior portion of temple piece 802 (e.g., close to the bridge), so that its signal is minimally impacted by the wearer's head. In one example, wireless communications can be used to communicate audio signals from one side (one temple) to the other, in the instance where there are loudspeakers in both temples. Power for the loudspeakers can be provided locally (e.g., with a battery in the temple piece), or there can be a single battery and power can be transferred via wiring (not shown) that passes through the bridge or is otherwise transferred from one temple piece to the other.

Elements of FIG. 11 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

A number of implementations have been described. Nevertheless, it will be understood that additional modifications may be made without departing from the scope of the inventive concepts described herein, and, accordingly, other embodiments are within the scope of the following claims.

What is claimed is:

1. An audio eyeglass device, comprising:

an eyeglass frame that is configured to be worn on the head of a wearer, the eyeglass frame comprising a bridge that is configured to be supported by the wearer's nose, and a left temple piece and a right temple piece that each extend rearwardly from the bridge toward the left and right ears of the wearer, respectively;

a first housing in the left temple piece and having opposed front and rear faces and opposed first and second ends;

a first rectangular electro-acoustic transducer located in the first housing and comprising a first substantially flat diaphragm with a front face and a rear face, the first diaphragm configured to move along a first radiation axis and radiate front acoustic radiation from its front face and into a first front acoustic volume and rear acoustic radiation from its rear face and into a first rear acoustic volume, wherein the front and rear acoustic radiations are out of phase;

first and second sound-emitting outlets in the first housing, wherein the first sound-emitting outlet in the first housing is in or proximate the first end of the first housing, defines a center, and is acoustically coupled to the first front acoustic volume so as to emit front acoustic radiation from the first housing, and wherein the second sound-emitting outlet in the first housing is in or proximate the second end of the first housing, defines a center, and is acoustically coupled to the first rear acoustic volume so as to emit rear acoustic radiation from the first housing, wherein a distance between the centers of the first and second sound-emitting outlets in the first housing is greater than a distance along the first diaphragm radiation axis between the front and rear faces of the first housing;

a second housing in the right temple piece and having opposed front and rear faces and opposed first and second ends;

a second rectangular electro-acoustic transducer located in the second housing and comprising a second substantially flat diaphragm with a front face and a rear face, the second diaphragm configured to move along a second radiation axis and radiate front acoustic radiation from its front face and into a second front acoustic volume and rear acoustic radiation from its rear face and into a second rear acoustic volume, wherein the front and rear acoustic radiations are out of phase; and first and second sound-emitting outlets in the second housing, wherein the first sound-emitting outlet in the second housing is in or proximate the first end of the second housing, defines a center, and is acoustically coupled to the second front acoustic volume so as to emit front acoustic radiation from the second housing, and wherein the second sound-emitting outlet in the second housing is in or proximate the second end of the second housing, defines a center, and is acoustically coupled to the first rear acoustic volume so as to emit rear acoustic radiation from the second housing, wherein a distance between the centers of the first and second sound-emitting outlets in the second housing is greater than a distance along the second diaphragm radiation axis between the front and rear faces of the second housing.

2. The audio eyeglass device of claim 1, wherein the second sound-emitting opening in the first housing is closer to the bridge than is the first sound-emitting opening in the first housing, and wherein the second sound-emitting opening in the second housing is closer to the bridge than is the first sound-emitting opening in the second housing.

3. The audio eyeglass device of claim 1, wherein the first radiation axis is configured to be transverse to a first side of the head of the wearer and the second radiation axis is configured to be transverse to a second side of the head of the wearer.

4. The audio eyeglass device of claim 3, wherein the first radiation axis is configured to be perpendicular to the first side of the head of the wearer and the second radiation axis is configured to be perpendicular to the second side of the head of the wearer.

5. The audio eyeglass device of claim 1, wherein the first front acoustic volume for the first transducer is defined at least in part by an inside of the left temple piece, the first rear acoustic volume for the first transducer is defined at least in part by an inside of the left temple piece, the second front acoustic volume for the second transducer is defined at least in part by an inside of the right temple piece, and the second rear acoustic volume for the second transducer is defined at least in part by an inside of the right temple piece.

6. The audio eyeglass device of claim 1, wherein the first rear acoustic volume in the left temple piece comprises a space in a corner of the first transducer, and the second rear acoustic volume in the right temple piece comprises a space in a corner of the second transducer.

7. An audio eyeglass device, comprising:

an eyeglass frame that is configured to be worn on the head of a wearer, the eyeglass frame comprising a bridge that is configured to be supported by the wearer's nose, and a left temple piece and a right temple piece that each extend rearwardly from the bridge toward the left and right ears of the wearer, respectively;

a first rectangular electro-acoustic transducer located in the left temple piece and comprising a first substantially flat diaphragm with a front face and a rear face, the first diaphragm configured to move along a first radiation axis and radiate front acoustic radiation from its front face and into a first front acoustic volume and rear acoustic radiation from its rear face and into a first rear acoustic volume, wherein the front and rear acoustic radiations are out of phase;

a first primary magnet proximate the rear face of the first diaphragm;

a first magnetic circuit that defines a path for magnetic flux of the first primary magnet and comprises a first front pole piece between a front face of the first primary magnet and the rear face of the first diaphragm, a first rear pole piece proximate the rear face of the first primary magnet, and first and second side magnets, the first side magnet proximate to and spaced from a first side of the first primary magnet and the second side magnet proximate to and spaced from a second side of the first primary magnet, wherein the first magnetic circuit defines a first magnetic circuit gap between the first primary magnet and the first and second side magnets;

a second rectangular electro-acoustic transducer located in the right temple piece and comprising a second substantially flat diaphragm with a front face and a rear face, the second diaphragm configured to move along a second radiation axis and radiate front acoustic radiation from its front face and into a second front acoustic volume and rear acoustic radiation from its rear face and into a second rear acoustic volume, wherein the front and rear acoustic radiations are out of phase;

a second primary magnet proximate the rear face of the second diaphragm; and a second magnetic circuit that defines a path for magnetic flux of the second primary magnet and comprises a second front pole piece between a front face of the second primary magnet and the rear face of the second diaphragm, a second rear pole piece proximate the rear face of the second primary magnet, and first and second side magnets, the first side magnet proximate to and spaced from a first side of the second primary magnet and the second side magnet proximate to and spaced from a second side of the second primary magnet, wherein the second magnetic circuit defines a second magnetic circuit gap between the second primary magnet and the first and second side magnets.

8. An audio eyeglass device, comprising:

an eyeglass frame that is configured to be worn on the head of a wearer, the eyeglass frame comprising a bridge that is configured to be supported by the wearer's nose, and a left temple piece and a right temple piece that each extend rearwardly from the bridge toward the left and right ears of the wearer, respectively;

a first housing in the left temple piece and having opposed front and rear faces and opposed first and second ends;

a first electro-acoustic transducer located in the left temple piece and comprising a first flexible structure carried by a first transducer frame, wherein the first flexible structure is coupled to a first transducer diaphragm such that the first transducer diaphragm is configured to move along a first radiation axis and radiate front acoustic radiation from a first transducer diaphragm front face and into a first front acoustic volume, and rear acoustic radiation from a first transducer diaphragm rear face and into a first rear acoustic volume, wherein the front and rear acoustic radiations are out of phase;

a first opening in the first transducer frame and configured to pass rear acoustic radiation out of the first rear acoustic volume;

first and second sound-emitting outlets in the first housing, wherein the first sound-emitting outlet in the first housing is in or proximate the first end of the first housing, defines a center, and is acoustically coupled to the first front acoustic volume so as to emit front acoustic radiation from the first housing, and wherein the second sound-emitting outlet in the first housing is in or proximate the second end of the first housing, defines a center, and is acoustically coupled to the first rear acoustic volume so as to emit rear acoustic radiation from the first housing, wherein a distance between the centers of the first and second sound-emitting outlets in the first housing is greater than a distance along the first diaphragm radiation axis between the front and rear faces of the first housing;

a second housing in the right temple piece and having opposed front and rear faces and opposed first and second ends;

a second electro-acoustic transducer located in the right temple piece and comprising a second flexible structure carried by a second transducer frame, wherein the second flexible structure is coupled to a second transducer diaphragm such that the second transducer diaphragm is configured to move along a second radiation axis and radiate front acoustic radiation from a second transducer diaphragm front face and into a second front acoustic volume, and rear acoustic radiation from a second transducer diaphragm rear face and into a second rear acoustic volume, wherein the front and rear acoustic radiations are out of phase;

a second opening in the second transducer frame and configured to pass rear acoustic radiation out of the second rear acoustic volume; and first and second sound-emitting outlets in the second housing, wherein the first sound-emitting outlet in the second housing is in or proximate the first end of the second housing, defines a center, and is acoustically coupled to the second front acoustic volume so as to emit front acoustic radiation from the second housing, and wherein the second sound-emitting outlet in the second housing is in or proximate the second end of the second housing, defines a center, and is acoustically coupled to the first rear acoustic volume so as to emit rear acoustic radiation from the second housing, wherein a distance between the centers of the first and second sound-emitting outlets in the second housing is greater than a distance along the second diaphragm radiation axis between the front and rear faces of the second housing.

9. The audio eyeglass device of claim 8, wherein the second sound-emitting opening in the first housing is closer to the bridge than is the first sound-emitting opening in the first housing, and wherein the second sound-emitting opening in the second housing is closer to the bridge than is the first sound-emitting opening in the second housing.

10. The audio eyeglass device of claim 8, wherein the first radiation axis is configured to be transverse to a first side of the head of the wearer and the second radiation axis is configured to be transverse to a second side of the head of the wearer.

11. The audio eyeglass device of claim 10, wherein the first radiation axis is configured to be perpendicular to the first side of the head of the wearer and the second radiation axis is configured to be perpendicular to the second side of the head of the wearer.

12. The audio eyeglass device of claim 8, wherein the front acoustic volume for the first transducer is defined at least in part by an inside of the left temple piece, and the front acoustic volume for the second transducer is defined at least in part by an inside of the right temple piece.

13. An open audio device, comprising:

a support structure that is configured to be worn on the head of a wearer;

a first housing in the support structure and having opposed front and rear faces and opposed first and second ends;

a first rectangular electro-acoustic transducer carried by the support structure such that the first transducer is configured to be located close to the left ear of the wearer but not covering or occluding the left ear canal opening, wherein the first transducer comprises a first substantially flat diaphragm with a front face and a rear face, the first diaphragm configured to move along a first radiation axis and radiate front acoustic radiation from its front face and into a first front acoustic volume and rear acoustic radiation from its rear face and into a first rear acoustic volume, wherein the front and rear acoustic radiations are out of phase;

first and second sound-emitting outlets in the first housing, wherein the first sound-emitting outlet in the first housing is in or proximate the first end of the first housing, defines a center, and is acoustically coupled to the first front acoustic volume so as to emit front acoustic radiation from the first housing, and wherein the second sound-emitting outlet in the first housing is in or proximate the second end of the first housing, defines a center, and is acoustically coupled to the first rear acoustic volume so as to emit rear acoustic radiation from the first housing, wherein a distance between the centers of the first and second sound-emitting outlets in the first housing is greater than a distance along the first diaphragm radiation axis between the front and rear faces of the first housing;

a second housing in the support structure and having opposed front and rear faces and opposed first and second ends;

a second rectangular electro-acoustic transducer carried by the support structure such that the second transducer is configured to be located close to the right ear of the wearer but not covering or occluding the right ear canal opening, wherein the second transducer comprises a second substantially flat diaphragm with a front face and a rear face, the second diaphragm configured to move along a second radiation axis and radiate front acoustic radiation from its front face and into a second front acoustic volume and rear acoustic radiation from its rear face and into a second rear acoustic volume, wherein the front and rear acoustic radiations are out of phase; and first and second sound-emitting outlets in the second housing, wherein the first sound-emitting outlet in the second housing is in or proximate the first end of the second housing, defines a center, and is acoustically coupled to the second front acoustic volume so as to emit front acoustic radiation from the second housing, and wherein the second sound-emitting outlet in the second housing is in or proximate the second end of the second housing, defines a center, and is acoustically coupled to the first rear acoustic volume so as to emit rear acoustic radiation from the second housing, wherein a distance between the centers of the first and second sound-emitting outlets in the second housing is greater than a distance along the second diaphragm radiation axis between the front and rear faces of the second housing.

14. The open audio device of claim 13, wherein the first sound emitting opening of the first transducer is configured to be closer to the left ear of the wearer than is the second sound emitting opening of the first transducer, and wherein the first sound emitting opening of the second transducer is configured to be closer to the right ear of the wearer than is the second sound emitting opening of the second transducer.

15. The open audio device of claim 14, wherein the first radiation axis is configured to be perpendicular to a first side of the head of the wearer and the second radiation axis is configured to be perpendicular to a second side of the head of the wearer.

16. An audio eyeglass device, comprising:

an eyeglass frame that is configured to be worn on the head of a wearer, the eyeglass frame comprising a bridge that is configured to be supported by the wearer's nose, and a left temple piece and a right temple piece that each extend rearwardly from the bridge toward the left and right ears of the wearer, respectively;

a first electro-acoustic transducer located in the left temple piece and comprising a first flexible structure carried by a first transducer frame, wherein the first flexible structure is coupled to a first transducer diaphragm such that the first transducer diaphragm is configured to move along a first radiation axis and radiate front acoustic radiation from a first transducer diaphragm front face and into a first front acoustic volume, and rear acoustic radiation from a first transducer diaphragm rear face and into a first rear acoustic volume, wherein the front and rear acoustic radiations are out of phase;

a first opening in the first transducer frame and configured to pass rear acoustic radiation out of the first rear acoustic volume;

a first primary magnet proximate the rear face of the first diaphragm;

a first magnetic circuit that defines a path for magnetic flux of the first primary magnet and comprises a first front pole piece between a front face of the first primary magnet and the rear face of the first diaphragm, a first rear pole piece proximate the rear face of the first primary magnet, and first and second side magnets, the first side magnet proximate to and spaced from a first side of the first primary magnet and the second side magnet proximate to and spaced from a second side of the first primary magnet, wherein the first magnetic circuit defines a first magnetic circuit gap between the first primary magnet and the first and second side magnets;

a second electro-acoustic transducer located in the right temple piece and comprising a second flexible structure carried by a second transducer frame, wherein the second flexible structure is coupled to a second transducer diaphragm such that the second transducer diaphragm is configured to move along a second radiation axis and radiate front acoustic radiation from a second transducer diaphragm front face and into a second front acoustic volume, and rear acoustic radiation from a second transducer diaphragm rear face and into a second rear acoustic volume, wherein the front and rear acoustic radiations are out of phase;

a second opening in the second transducer frame and configured to pass rear acoustic radiation out of the second rear acoustic volume;

a second primary magnet proximate the rear face of the second diaphragm; and a second magnetic circuit that defines a path for magnetic flux of the second primary magnet and comprises a second front pole piece between a front face of the second primary magnet and the rear face of the second diaphragm, a second rear pole piece proximate the rear face of the second primary magnet, and first and second side magnets, the first side magnet proximate to and spaced from a first side of the second primary magnet and the second side magnet proximate to and spaced from a second side of the second primary magnet, wherein the second magnetic circuit defines a second magnetic circuit gap between the second primary magnet and the first and second side magnets.

17. An open audio device, comprising:

a support structure that is configured to be worn on the head of a wearer;

a first rectangular electro-acoustic transducer carried by the support structure such that the first transducer is configured to be located close to the left ear of the wearer but not covering or occluding the left ear canal opening, wherein the first transducer comprises a first substantially flat diaphragm with a front face and a rear face, the first diaphragm configured to move along a first radiation axis and radiate front acoustic radiation from its front face and into a first front acoustic volume and rear acoustic radiation from its rear face and into a first rear acoustic volume, wherein the front and rear acoustic radiations are out of phase;

a first primary magnet proximate the rear face of the first diaphragm;

a first magnetic circuit that defines a path for magnetic flux of the first primary magnet and comprises a first front pole piece between a front face of the first primary magnet and the rear face of the first diaphragm, a first rear pole piece proximate the rear face of the first primary magnet, and first and second side magnets, the first side magnet proximate to and spaced from a first side of the first primary magnet and the second side magnet proximate to and spaced from a second side of the first primary magnet, wherein the first magnetic circuit defines a first magnetic circuit gap between the first primary magnet and the first and second side magnets;

a first sound-emitting opening that is configured to emit sound from the first front acoustic volume of the first transducer and a second sound-emitting opening that is configured to emit sound from the first rear acoustic volume of the first transducer;

a second rectangular electro-acoustic transducer carried by the support structure such that the second transducer is configured to be located close to the right ear of the wearer but not covering or occluding the right ear canal opening, wherein the second transducer comprises a second substantially flat diaphragm with a front face and a rear face, the second diaphragm configured to move along a second radiation axis and radiate front acoustic radiation from its front face and into a second front acoustic volume and rear acoustic radiation from its rear face and into a second rear acoustic volume, wherein the front and rear acoustic radiations are out of phase;

a second primary magnet proximate the rear face of the second diaphragm;

a second magnetic circuit that defines a path for magnetic flux of the second primary magnet and comprises a second front pole piece between a front face of the second primary magnet and the rear face of the second diaphragm, a second rear pole piece proximate the rear face of the second primary magnet, and first and second side magnets, the first side magnet proximate to and spaced from a first side of the second primary magnet and the second side magnet proximate to and spaced from a second side of the second primary magnet, wherein the second magnetic circuit defines a second magnetic circuit gap between the second primary magnet and the first and second side magnets; and a first sound-emitting opening that is configured to emit sound from the second front acoustic volume of the second transducer and a second sound-emitting opening that is configured to emit sound from the second rear acoustic volume of the second transducer.

* * * * *